US006495957B2

(12) United States Patent
Kurogi et al.

(10) Patent No.: US 6,495,957 B2
(45) **Date of Patent: *Dec. 17, 2002**

(54) PLASMA DISPLAY PANEL WITH VARIOUS ELECTRODE PROJECTION CONFIGURATIONS

(75) Inventors: Seiki Kurogi, Kagoshima (JP); Yoshitaka Ukai, Kagoshima (JP); Kenji Yoshida, Kawasaki (JP); Takashi Katayama, Kawasaki (JP); Hiroyuki Nakahara, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,199

(22) Filed: Feb. 25, 1999

(65) Prior Publication Data

US 2002/0008474 A1 Jan. 24, 2002

(30) Foreign Application Priority Data

Oct. 9, 1998 (JP) ..... 10-287424

(51) Int. Cl.[7] ..... H01J 17/49
(52) U.S. Cl. ..... 313/584; 313/491
(58) Field of Search ..... 313/491, 584, 313/582, 484, 493, 495–497; 315/169.4; 345/37

(56) References Cited

U.S. PATENT DOCUMENTS

| | | | | |
|---|---|---|---|---|
| 5,640,068 A | * | 6/1997 | Amemiya | 313/582 |
| 5,659,226 A | * | 8/1997 | Shigeta | 313/491 |
| 6,144,348 A | * | 11/2000 | Kananzawa et al. | 315/169.1 |

FOREIGN PATENT DOCUMENTS

| | | | | |
|---|---|---|---|---|
| EP | 03187125 | | 8/1991 | |
| EP | 0762373 A | * | 5/1996 | G09G/3/28 |
| EP | 0782167 A | * | 2/1997 | H01J/17/49 |
| EP | 0762373 A2 | | 3/1997 | |
| EP | 0764931 A2 | | 3/1997 | |
| EP | 0782167 A2 | | 7/1997 | |
| EP | 0895270 A2 | | 2/1999 | |
| JP | 2-220330 | | 9/1990 | |
| JP | 8-22772 | | 1/1996 | |
| JP | 8-95500 | | 4/1996 | |
| JP | 09120777 | | 5/1997 | |
| JP | 9-160525 | | 6/1997 | |

* cited by examiner

*Primary Examiner*—Vip Patel
*Assistant Examiner*—Ken A Berck
(74) *Attorney, Agent, or Firm*—Staas & Halsey LLP

(57) ABSTRACT

A plasma display panel includes a plurality of row electrodes defining rows of a screen. The row electrodes are arranged at intervals so that adjacent row electrodes are capable of serving as an electrode pair for generating a surface discharge. Each of the row electrodes includes a belt-shaped base extending along the full length of the screen in a direction of the rows and protrusions extending from the base toward an adjacent row electrode in every column.

21 Claims, 12 Drawing Sheets

PLASMA DISPLAY PANEL WITH VARIOUS ELECTRODE PROJECTION CONFIGURATIONS

CROSS-REFERENCE TO RELATED APPLICATION

This application is related to Japanese application No. HEI 10(1998)-287424 filed on Oct. 9, 1998, whose priority is claimed under 35 USC §119, the disclosure of which is incorporated by reference in its entirety.

BACKGROUND OF THE INVENTION

1. Field of the Invention

The present invention relates to a plasma display panel (PDP) of a surface-discharge type and a display device using the same.

PDPs have become widely used for television monitors, video monitors for computers and the like since color display became practical with PDPs. For further spread of the PDPs, structures suitable for high definition are being developed.

2. Description of Related Art

Three-electrode AC surface-discharge PDPs are commercialized as color display devices. Here, the surface-discharge structure means a structure in which a first main electrode and a second main electrode are arranged in parallel on an inner surface of one of paired substrates (referred to as a first substrate). The first and second main electrodes serve as a positive electrode and a negative electrode alternately in AC drive for sustaining a light-emitting state by use of wall charge. With this structure, fluorescent layers for color display can be disposed on a second substrate opposed to the first substrate having the main electrodes disposed thereon, thereby to be kept at a distance from the main electrodes. Thereby, the deterioration of the fluorescent layers due to ion impact at electric discharges can be reduced for longer life of PDPs. Since the main electrodes extend in the same direction as row electrodes defining rows of a screen, the surface-discharge PDPs need third electrodes (column electrodes) for selecting cells on the rows and barrier ribs for partitioning a discharge space for every column. The main electrodes are each in the shape of a linear belt extending along the full width of the screen. As regards arrangement of the barrier ribs, a stripe pattern in which the barrier ribs are arranged in the shape of linear belts in plan view is superior from the view point of productivity to a mesh pattern in which the barrier ribs separates the cells individually.

In a typical configuration of the three-electrode structure, a pair of main electrodes is arranged on every row of the screen. The distance between the two main electrodes of each row (referred to as a surface-discharge gap) is set about several tens of microns so that discharges are generated by application of a voltage of about 150 to 200 volts. On the other hand, the distance between the main electrodes on adjacent rows (referred to as a reverse slit) is set sufficiently larger than (about several times as large as) the surface-discharge gap in order to prevent unnecessary discharges across the rows and reduce electrostatic capacity. In other words, the interval between the main electrodes on a row is different from that between the main electrodes on adjacent rows. With this typical configuration, since the reverse gap does not contribute to light emission, the use of the screen is limited and is disadvantageous in brightness. Also, it is different to realize higher definition through reduction of a pitch between rows (row pitch).

There is conventionally proposed a technique wherein an arrangement of electrodes is adopted wherein N+1 main electrodes (N is the number of rows) are equidistantly disposed and two adjacent rows serve as an electrode pair for generating a surface discharge (illustrated in Japanese Unexamined Patent Publication No. HEI 2(1990)-220330) and a frame is divided into an odd-numbered field and an even-numbered field which are time-sequentially displayed (Japanese Unexamined Patent Publication No. HEI 9(1997)-160525). In this arrangement of electrodes, each main electrode except the ones on both ends makes electrode pairs with the main electrodes on both sides thereof in the direction of arrangement. That is, the main electrode is used for displaying both the odd-numbered fields and the even-numbered fields. The main electrodes on the ends each form an electrode pair with the main electrode on one side in the direction of arrangement. Only odd-numbered rows are used for displaying the odd-numbered field and only even-number rows are used for displaying the even-numbered field. For example, for sustaining the light-emitting state in the odd-number field, voltages of the same phase are applied to the main electrodes defining rows which are not used for display in this field (in this case, even-numbered rows). Thereby interference of discharges between the odd-numbered rows and the even-numbered rows can be reduced without need to provide barrier ribs between the rows.

With the above-described setting of the phrase of drive voltages, although unnecessary surface discharges can be prevented on the rows not used for display, discharges on the rows used for display expand toward adjacent rows, i.e., the rows not used for display. Accordingly, resolution in the direction of the columns (vertical resolution) is impaired.

SUMMARY OF THE INVENTION

An object of the present invention is to prevent the expansion of discharges in the column direction to improve the resolution.

The present invention provides a plasma display panel comprising a plurality of row electrodes defining rows of a screen, the row electrodes being arranged at intervals so that adjacent row electrodes are capable of serving as an electrode pair for generating a surface discharge, wherein each of the row electrodes includes a belt-shaped base extending along the full length of the screen in a direction of the rows and protrusions extending from the base toward an adjacent row electrode in every column.

In the present invention, the plan-view shape of the main electrodes disposed equidistantly is the shape of linear belts of constant width having partial cut-offs in such a manner that all cells have an equal electrode area. Since an electric field is not generated at a cut-off portion, the discharge produced on one side of the main electrode can be prevented from expanding to the other side thereof. Because the area of the electrode decreases by the area of the cutoff, discharge current decreases, so that a drive circuit is less burdened. Decline in brightness with the decrease of the discharge current can be compensated by raising the frequency of drive voltage for sustaining light emission.

DESCRIPTION OF THE PREFERRED EMBODIMENTS

Figure 1:
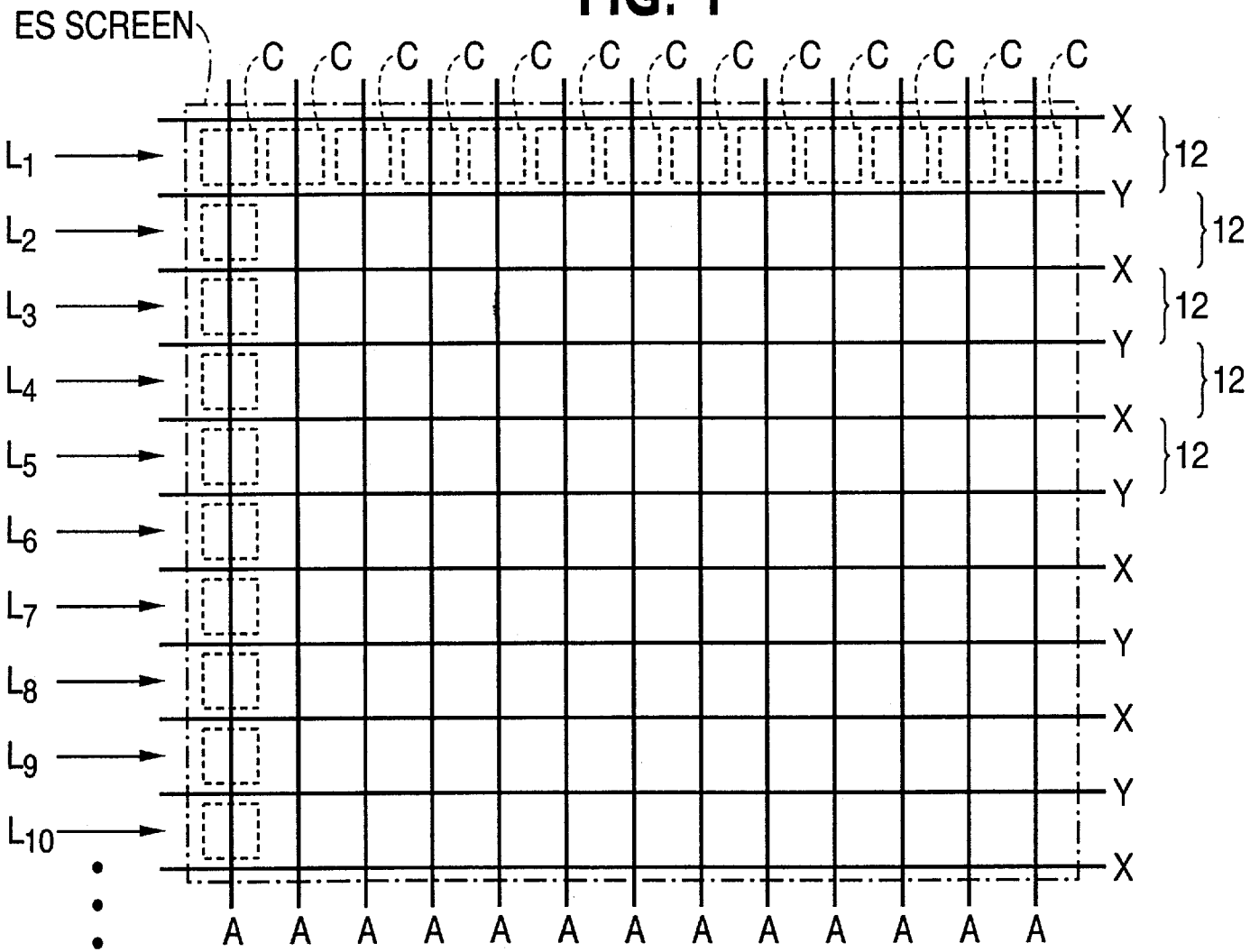
FIG. 1 is a schematic view illustrating a matrix of electrodes in accordance with the present invention.

In the plasma display panel of the invention, each of the protrusions may be formed to be wider at its end than at its root on the base.

In the plasma display panel of the invention, each of the row electrodes may include a belt-shaped base extending along the full length of the screen in a direction of the rows and T-shaped protrusions extending from the base toward an adjacent row electrode in every column.

Alternately each of the row electrodes may include a belt-shaped base extending along the full length of the screen in a direction of the rows and L-shaped protrusions extending from the base toward an adjacent row electrode in every column.

In the plasma display pane of the invention, in each row, roots of the L-shaped protrusions extending from one side of the base may be in position shifted in a direction of the rows with respect to roots of the L-shaped protrusions extending from the other side of the base.

In the plasma display panel of the invention, each of the row electrodes may include a belt-shaped base extending along the full length of the screen in a direction of the rows and protrusions extending from the base toward an adjacent row electrode in every column and the protrusions may be each formed in an elbow-shaped belt having a first linear portion extending from the base obliquely with respect to a direction of columns of the screen and a second linear portion extending in the direction of the row from the end of the first linear portion.

In the plasma display panel of the invention, the shape of each row electrode in a range corresponding to one column may be symmetric about a point positioned centrally in the direction of the row on the base.

In the plasma display panel of the invention, at least the protrusions of the row electrode may be formed of an electrically conductive transparent film.

In the plasma display panel of the invention, the base of the row electrode may be formed of a laminate of an electrically conductive transparent film and a metal film.

In the plasma display panel of the invention, each of the row electrodes may include a couple of belt-shaped electrodes spacedly extending along the full length of the screen in a direction of the rows and a connection for electrically connecting the belt-shaped electrodes outside the screen.

The belt-shaped electrodes may be formed of an electrically conductive transparent film and the connection is formed of a metal film.

In the plasma display panel of the invention, each of the row electrodes may include three or more belt-shaped electrodes spacedly extending along the full length of the screen in a direction of the rows and a connect for electrically connecting the belt-shaped electrodes in each column.

The plasma display panel of the invention may have belt-shaped ribs for partitioning the screen into columns. In each column, a discharge space is continuous along the full length of the screen in the direction of the column.

In the plasma display panel of the invention, the plural row electrodes may be arranged at equally spaced intervals.

In another aspect, the present invention provides a plasma display device including the above-described plasma display panel and a drive circuit for applying drive voltage to electrode pairs so that one of two fields into which one frame is divided is displayed by odd-numbered rows and the other of the two fields is displayed by even-numbered rows.

FIG. 1 is a schematic view illustrating a matrix of electrodes in accordance with the present invention.

In a surface-discharge PDP according to the present invention, a total of M address electrodes A are disposed as column electrodes and a total of (N+1) main electrodes X and Y are disposed as row electrodes orthogonally to the address electrodes A. The main electrodes X and Y are alternately arranged equidistantly. Here, M is the number of columns of a screen ES and N is the number of rows thereof. The distance between the main electrodes X and Y is set about tens of microns, which allow surface discharges to be generated by a drive voltage within a practical range (for example, 100V to 200V) . In the figure, the main electrodes X and Y appear thin, but actually the width of the main electrodes X and Y is larger than the distance therebetween.

In order of arrangement shown in the figure, the main electrodes X are odd-numbered and are electrically connected in groups as described below. The main electrodes Y, which are even-numbered, are separately controlled in row-by-row addressing and are electrically connected in groups in sustaining light emission as the main electrodes X. The main electrodes X and Y form electrode pairs 12 for generating surface discharges with adjacent main electrodes Y and X, and define rows L (a numeral script in the figure denotes the number of a row). That is, each of the main electrodes X and Y except the ones at the beginning and the end of the order of arrangement serves to operate two rows L (i.e., an odd-numbered row and an even-numbered-row) for display. Each of the main electrodes X at the beginning and the end of the order of arrangement serves to operate one row L for display. The row L is a set of cells C having the same position in alignment in the column direction. In an example shown in the figure, the cells C belonging to each row L are aligned on a line, but may be arranged to be off in the column direction every other column.

Figure 2:
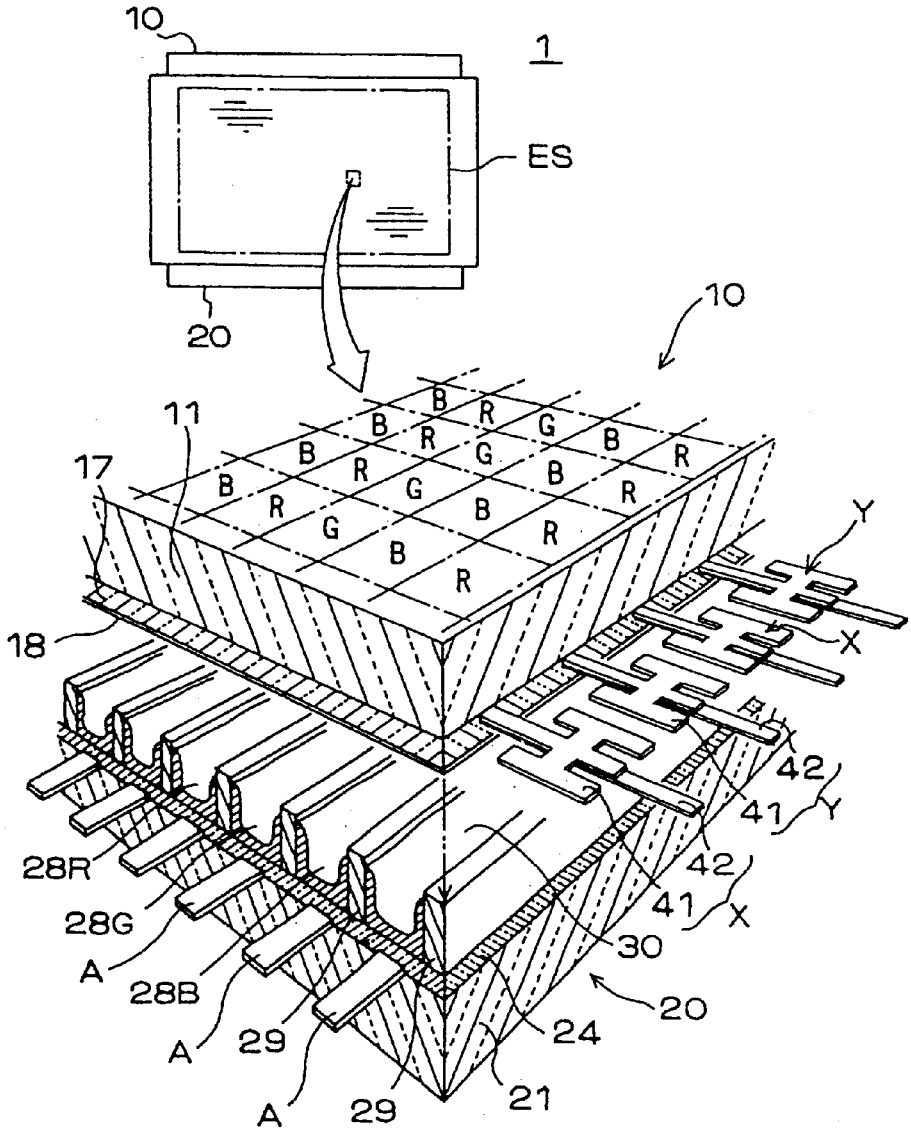
FIG. 2 is an exploded perspective view illustrating an inner construction of a PDP in accordance with the present invention.

FIG. 2 is an exploded perspective view illustrating an inner construction of a PDP 1 in accordance with the present invention.

Figure 4:
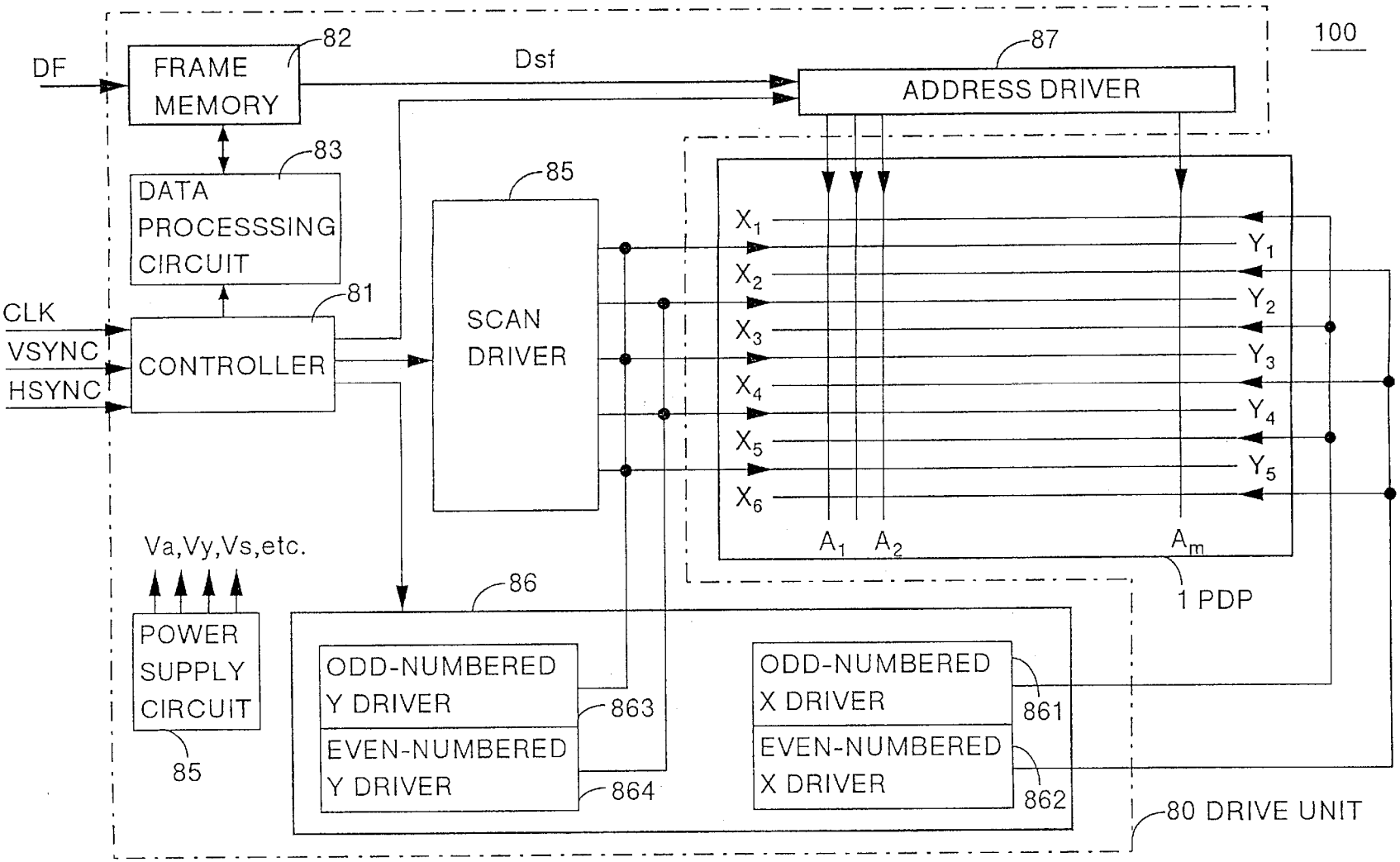
FIG. 4 is a diagram illustrating the construction of a plasma display device in accordance with the present invention.

The PDP 1 shown in the figure is an AC surface-discharge PDP for color display including a pair of substrate structures 10 and 20. In each cell (display element) composing a screen, a pair of main electrodes X an Y which are patterned into a shape specific to the present invention is crossed with an address electrode A which is a third electrode. The main electrodes X and Y are disposed on an inner surface of a glass substrate 11 which is a base material of the substrate structure 10 on the front side. The main electrodes X and Y are each comprised of a transparent conductive film 41 and a metal film (bus electrode) 42 for ensuring conductivity. The metal film 42 is comprised, for example, of a three-layer structure of chromium-copper-chromium and placed in the middle of the transparent conductive film 41. Here, since the chromium film which is the bottom layer of the metal film 42 is black and opaque, the chromium film can prevent fluorescent substances on the substrate structure on the rear side from being seen through the substrate structure on the front side as well as can block leak of light generated by discharges in adjacent cells. The chromium film functions as a so-called black stripe. This function is sufficiently effective where the distance between the rows is, for example, 510 $\mu$m and then the metal film is about 150 $\mu$m wide. An end portion of the metal film is lead out as a lead-out terminal of the main electrode X or Y to a peripheral end of the glass substrate 11. For example, the lead-out terminals of the main electrodes X are lead out to the left peripheral end of the substrate and the lead-out terminals of the main electrodes Y are lead out to the right peripheral end of the substrate, as shown in FIG. 4. A dielectric layer 17 of about 30 to 50 $\mu$m thickness is provided to cover the main electrodes X and Y, and magnesia (MgO) is applied as a protective film 18 onto the surface of the dielectric layer 17.

The address electrodes A are disposed on an inner surface of a glass substrate 21 which is a base material of the substrate structure 20 on the rear side. The address electrodes A are covered with a dielectric layer 24. Barrier ribs 29 in the form of plan-view liner belts are provided on the dielectric layer 24, each being disposed between address electrodes A. The barrier ribs 29 partition a discharge space 30 in the row direction (in a horizontal direction on the screen) along the columns and also define the spacing of the discharge space 30. Fluorescent layers 28R, 28G and 28B of three colors R, G and B for color display are provided to cover the inner surface on the rear side including top faces of the barrier ribs and side-walls of the barrier ribs. The discharge space 30 is filled with a discharge gas containing neon as the main component mixed with xenon. The fluorescent layers 28R, 28G and 28B are excited locally by ultraviolet radiation emitted by xenon and emit light when discharges occurs. One pixel for display is composed of three adjacent sub-pixels aligned in the row direction. A structure in each sub-pixel is a cell (display element) C. Since the barrier ribs 29 are arranged in a plan-view stripe pattern, each portion of the discharge space 30 corresponding to each column is continuous in the column direction bridging all the rows.

Figure 3:
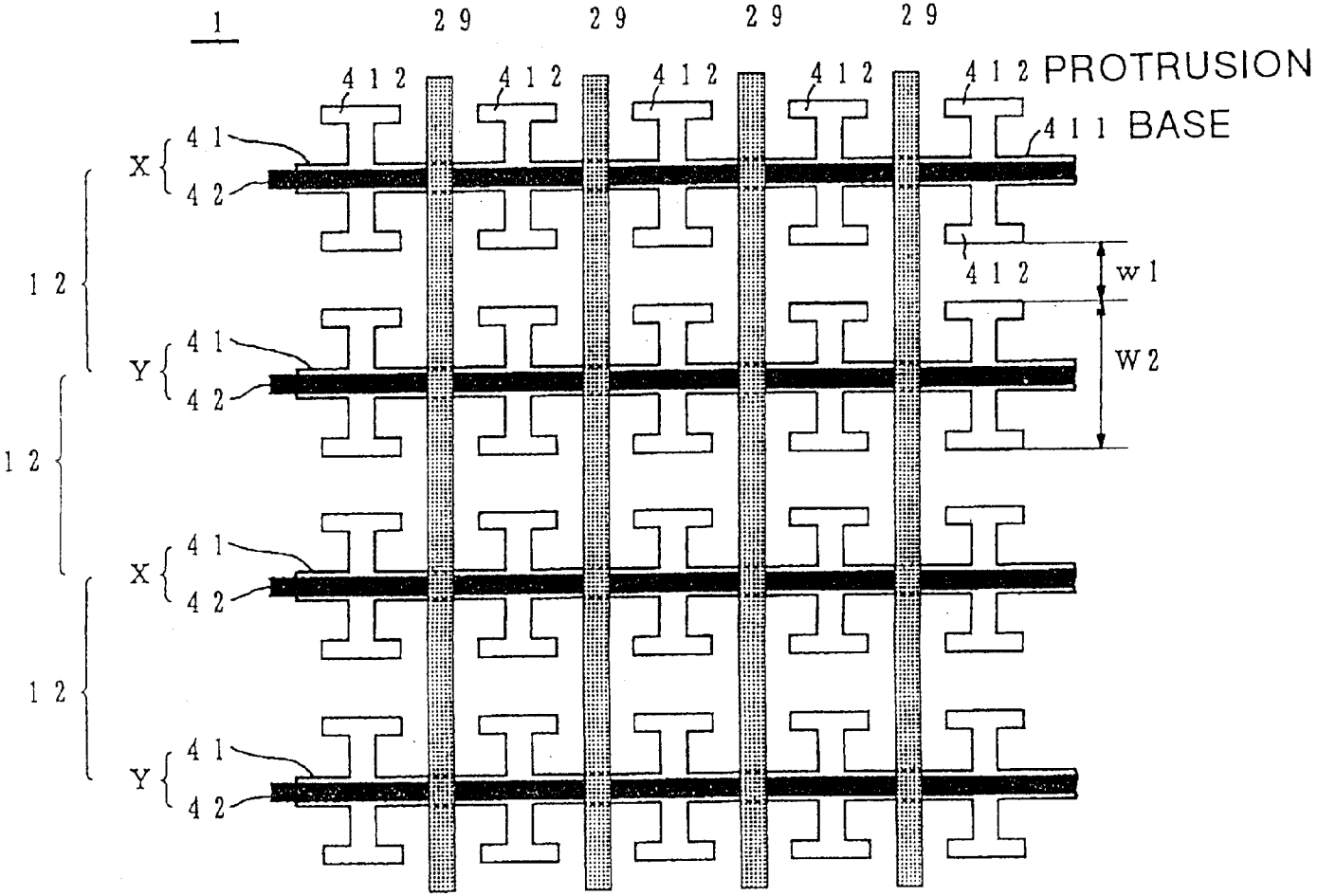
FIG. 3 is a plan view illustrating a configuration of main electrodes in accordance with a first embodiment of the present invention.

FIG. 3 is a plan view illustrating an exemplary configuration of the main electrodes in accordance with a first embodiment of the present invention.

The main electrodes X an Y are each composed of an electrically conductive transparent film 41 and a metal film 42 as described above. Since the entire metal film 42 is overlaid on the conductive transparent film 41 within the range of the screen, the plan-view shape of the conductive transparent film 41 itself is the shape of the main electrode X or Y.

The conductive transparent film 41 is patterned to include a belt-shaped base 411 linearly extending along the full length of the screen in the row direction and T-shaped protrusions 412 extending from the base 411 toward an adjacent conductive transparent film 41. In each of the columns partitioned by the barrier ribs, the protrusions 412 project on both sides of the base 411. The distance between the end of the protrusion 412 on one side and the end of the protrusion 412 on the other side is the width w2 of the main electrode X or Y. The interval between the protrusions 412 in the electrode pair 12 is the surface-discharge gap w1. Among all the main electrodes X and Y, the width w2 is uniform.

By providing the main electrodes X and Y with such a shape as the belt shape of width w2 is partially cut off, the surface discharge can be localized near the discharge gap and therefore the resolution can be improved. Further, since the protrusions 412 are spaced in the column direction and the distance between the main electrodes becomes larger than the surface-discharge gap w1 periodically in the row direction, the electrostatic capacity is smaller than in the case where the distance between the main electrodes is constant along the full length in the row direction, and therefore drive characteristics improve. In addition to that, since the area of the electrodes becomes smaller and the discharge current decreases, demand for current capacity from a drive circuit is eased. Decline in brightness with the decrease of the discharge current can be compensated by raising drive frequency.

The PDP 1 having the above construction can be used for a wall-mountable television display, a monitor of a computer system or the like in combination with a known circuit unit realizing interlaced driving.

FIG. 4 is a diagram illustrating the construction of a plasma display device 100 in accordance with the present invention.

The plasma display device 100 comprises a PDP 1 and a drive unit 80. The drive unit 80 includes controller 81, a frame memory 82, a data processing circuit 83, a power supply circuit 84, a scan driver 85, a sustain circuit 86 and an address driver 87. The sustain circuit 86 includes an odd-numbered X driver 861, an even-numbered X driver 862, an odd-numbered Y driver 863 and an even-numbered Y driver 864. The drive unit 80 is disposed on the rear side of the PDP 1. The drivers are electrically connected to electrodes of the PDP 1 by flexible cables, not shown. Frame data DF representing levels of brightness (levels of gradation) of the colors R, G and B on a pixel basis is input to the drive unit 80 from external equipment such as a TV tuner, a computer or the like, together with various synchronizing signals (CLK, HSYNC, VSYNC).

The frame data DF is stored in the frame memory 82 and then converted by the data processing circuit 83 to sub-field data Dsf for gradation display in a predetermined number of sub-fields into which the frame is time-sequentially divided. The sub-field data Dsf is stored in the frame memory 82 and transferred to the address driver 87 at appropriate times. The value of each bit in the sub-field data Dsf indicates whether or not a cell should be illuminated in a sub-field, more strictly whether or not an address discharge should be generated.

The scan driver 85 applies a drive voltage separately to the main electrode Y in the addressing. The odd-numbered X driver 861 applies a drive voltage simultaneously to the odd-numbered ones of the main electrodes X. The even-numbered X driver 862 applies the drive voltage simultaneously to the even-numbered ones of the main electrodes X. The odd-numbered Y driver 863 applies a drive voltage simultaneously to the odd-numbered ones of the main electrodes Y. The even-numbered X driver 864 applies the drive voltage simultaneously to the even-numbered ones of the main electrodes Y. The electric connection of the main electrodes X or Y can be realized not only by connection on the panel as shown in the figure, but also by interconnection within the drivers or by wiring on cables for connection use. The address driver 87 applies a drive voltage selectively to the M address electrodes A according to the sub-field data Dsf. These drivers are provided with proper amounts of power from the power supply circuit via conductive materials for wiring, not shown.

Now explanation is given as to how to drive the PDP 1.

Figure 5:
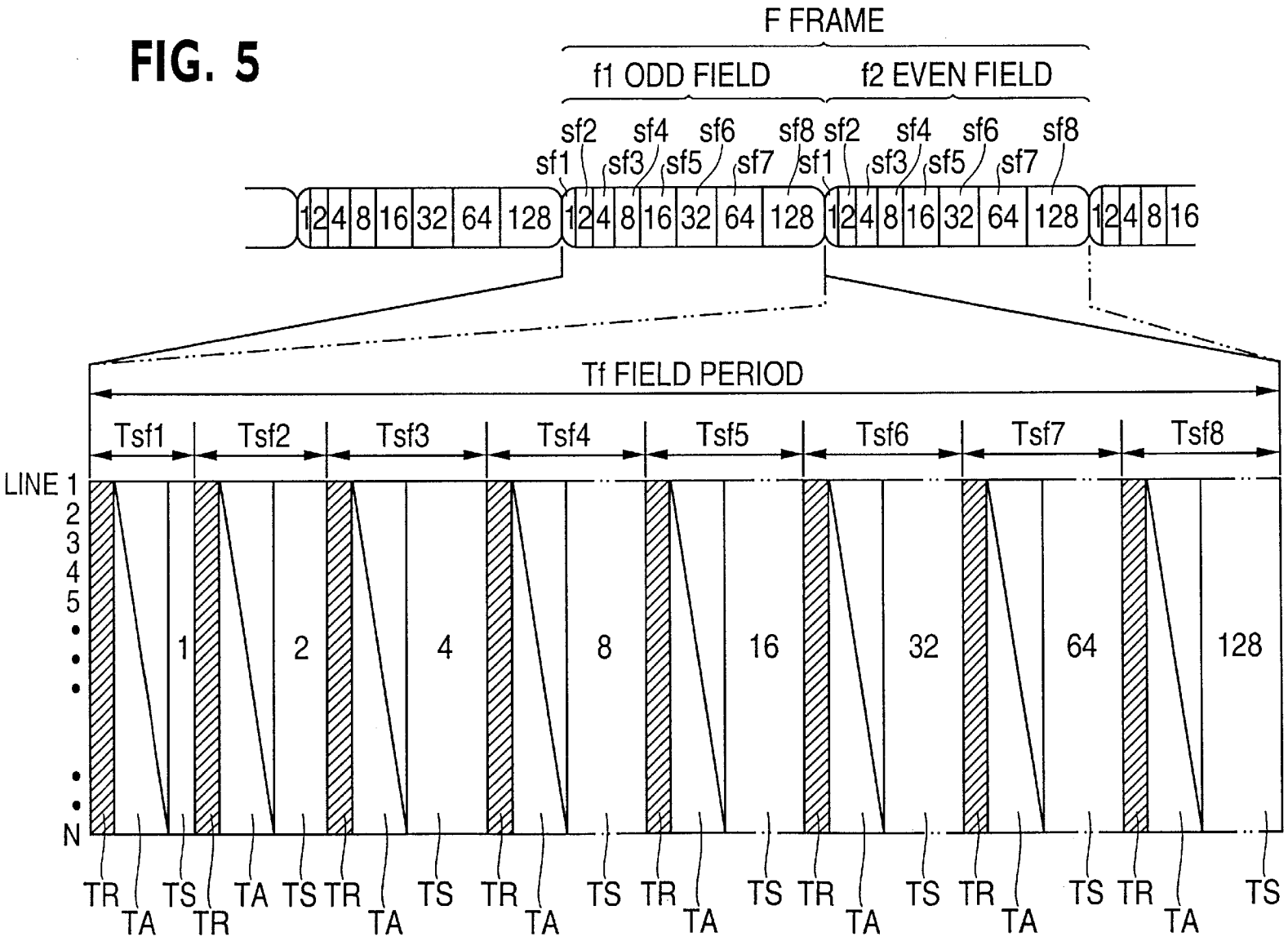
FIG. 5 illustrates the composition of a frame.

FIG. 5 illustrates the composition of a frame. For driving the PDP 1, the frame F which is image data for one scene is divided into an odd field f1 and an even field f2. In the odd field, the odd-numbered rows are used for display, and in the even field, the even-numbered rows are used for display. In other words, data for one scene is displayed in an interlacing manner.

For displaying levels of gradation (reproducing colors) by binary control on illumination, the odd field f1 and the even field f2 are each divided into, for example, eight sub-fields sf1, sf2, sf3, sf4, sf5, sf6, sf7 and sf8. In other words, each of the fields is replaced with a set of sub-fields sf1 to sf8. The sub-fields sf1 to sf8 are assigned weights of luminance so that relative ratio of luminance in the sub-fields sf1 to sf8 is about 1:2:4:8:16:32:64:128, and the numbers of discharges for sustaining illumination in the sub-fields sf1 to sf8 are determined according to the assigned weights of luminance. Since 256 levels of luminance can be realized for each of the colors R, G and B by setting illumination/non-illumination on a sub-field basis, the number of displayable colors amounts to $256^3$. It is noted that the sub-fields sf1 to sf8 need not be displayed in ascending order of weights of luminance. For example, the sub-field sf8 having the largest weight of luminance may be put in the middle of a field time period Tf for optimization.

Sub-field time periods $Tsf_j$ (j=1 to 8) allotted to the sub-fields $sf_j$ are each comprised of an address preparation period TR for uniforming charge distribution on the entire screen, an address period TA for producing a state charged according to the content to be displayed, and a sustain period TS for sustaining the light-emitting state for ensuring luminance according to the level of gradation to be reproduced. In all the sub-field periods $Tsf_j$, the lengths of the address preparation period TR and the address period TA are constant regardless of the weights of luminance assigned to the sub-fields $sf_j$. The greater the weight of luminance assigned to the sub-field $sf_j$ is, the longer the sustain period TS is. That is, the eight sub-field periods $Tsf_j$ corresponding to one field f are different in length.

Figure 6:
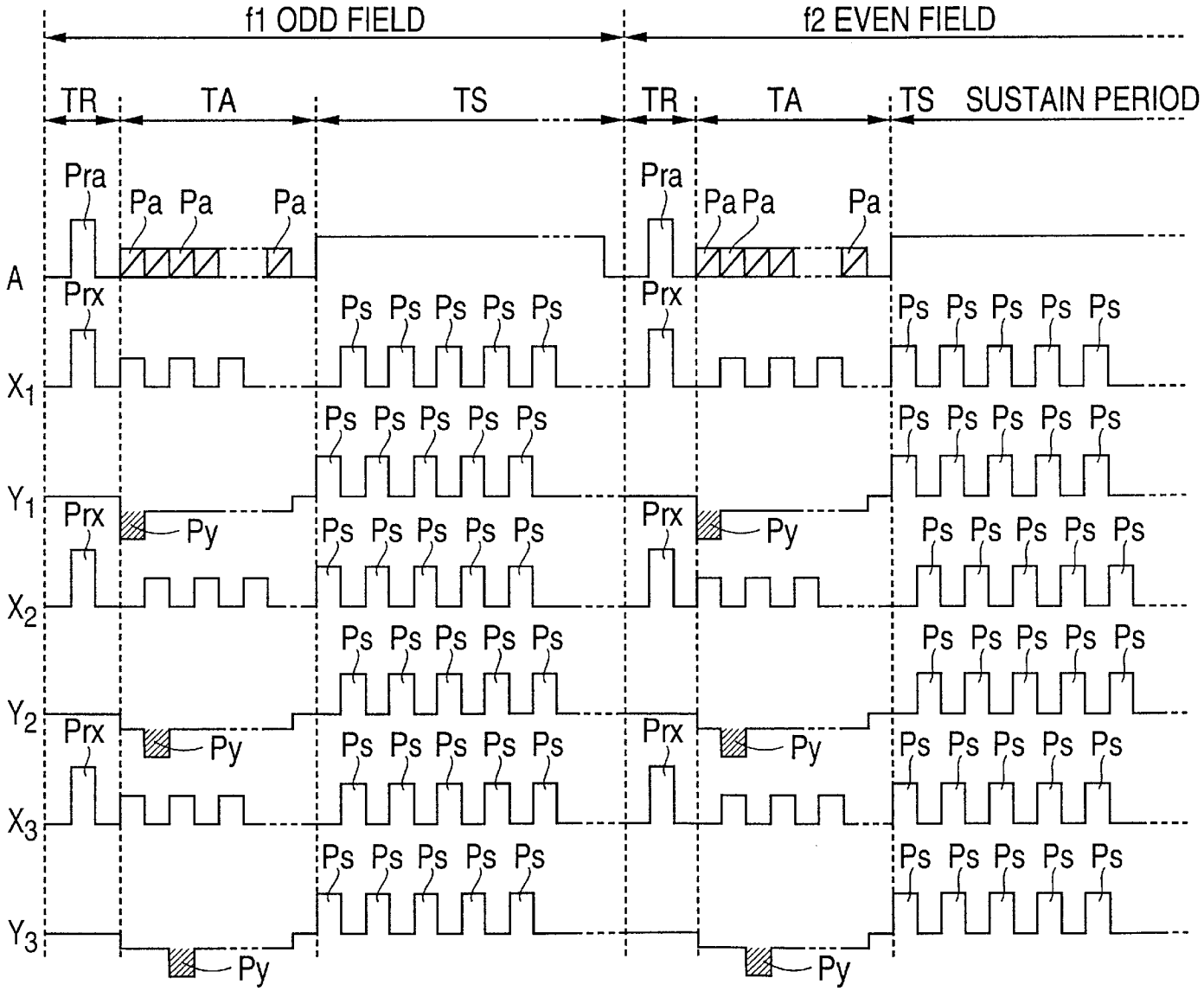
FIG. 6 shows voltage waveforms illustrating an exemplary drive sequence.

FIG. 6 shows voltage waveforms illustrating an exemplary drive sequence.

In the sub-fields of the odd field f1, a write pulse Prx whose peak value exceeds a firing voltage is first applied to all the main electrodes X in the address preparation period TR. Simultaneously, a pulse Pra is applied to all the address electrodes A so as not to generate discharges across the address electrodes A and the main electrodes X to which the write pulse Prx is applied. A surface discharge caused by the application of the write pulse Prx produces an excessive wall charge in each cell, and this excessive wall charge almost disappears through a self-erase discharge at a falling edge of the write pulse Prx. Next, in the address period TA, a scan pulse Py is applied sequentially to the main electrodes Y for line selection. Synchronically with the application of the scan pulse Py, an address pulse Pa is applied to address electrodes A corresponding to cells to be illuminated on a selected line so as to generate an address discharge. Also a pulse is applied alternately to the odd-numbered main electrodes X and the even-numbered main electrodes X so that appropriate discharges are produced on the odd-numbered rows. Then, in the sustain period TS, a sustain pulse Ps is applied to the main electrodes X andY at such a timing that the sustain pulse Ps is applied alternately to the main electrodes X and Y on the odd-numbered rows and at the same time on the even-numbered rows.

Also in the sub-fields of the even field f2, the write pulse Prx is applied to all the main electrodes X to erase the wall charge in the address preparation period TR. In the address period TA, also as in the odd field f1, the scan pulse Py is applied sequentially to the main electrodes Y, and the address pulse Pa is applied to designated electrodes A. In the even field f2, however, a pulse is applied alternately to the odd-numbered main electrodes X and the even-numbered main electrodes X synchronically with the scan pulse Py so that appropriate discharges are produced on the even-numbered rows. In the sustain period TS, the sustain pulse Ps is applied to the main electrodes X and Y at such a timing that the sustain pulse Ps is applied alternately to the main electrodes X and Y on the even-numbered rows and at the same time on the odd-numbered rows.

FIGS. 7 to 10 are plan views illustrating modified configurations of the main electrodes in accordance with the present invention.

Figure 7:
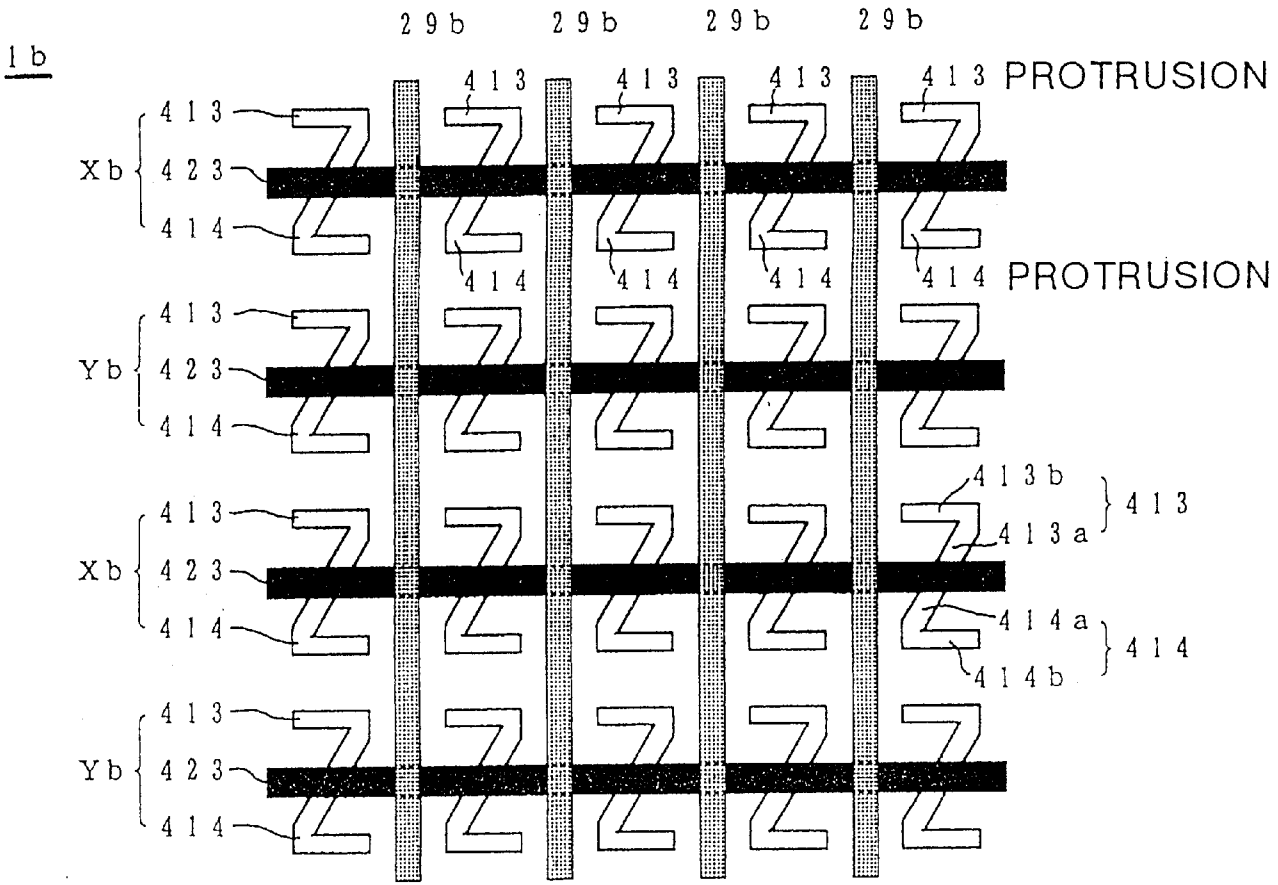
FIG. 7 is a plan view illustrating a modified configuration of main electrodes in accordance with the present invention.

In a PDP 1*b* shown in FIG. 7, main electrodes Xb and Yb are each composed of a base 423 in the form of a linear belt extending in the row direction and protrusions 413 and 414 extending from the base 423 in every column. The protrusions 413 and 414 are an upper part and a lower part of a conductive transparent film patterned in a Z shape which includes linear regions 413*a* and 414*a* extending obliquely to the column direction and linear regions 413*b* and 414*b* extending in the row direction. The protrusions 413 and 414 are overlapped with a metal film forming the base 423 in such a manner that the metal film crosses the center of the Z shape, thereby to form the main electrode Xb or Yb. With this configuration, the regions between the end of the protrusions 413 and 414 and the base 423 are oblique with respect to the column direction. Accordingly, even if the paired substrate structures become out of position in the row direction at the assembly of the PDP 1*b* and are shifted with respect to barrier ribs 29*b*, the area of part of the main electrode Yb facing the address electrode does not decrease to an extreme extent, and therefore the addressing can be highly relied on. Further, since the protrusions 413 and 414 have an elbow shape, the distance in the direction in which discharges expand becomes longer compared with the shape of the protrusions described before with reference to FIG. 3. Accordingly the expansion of discharges takes longer time and the effect of preventing the expansion of discharges is improved.

Figure 8:
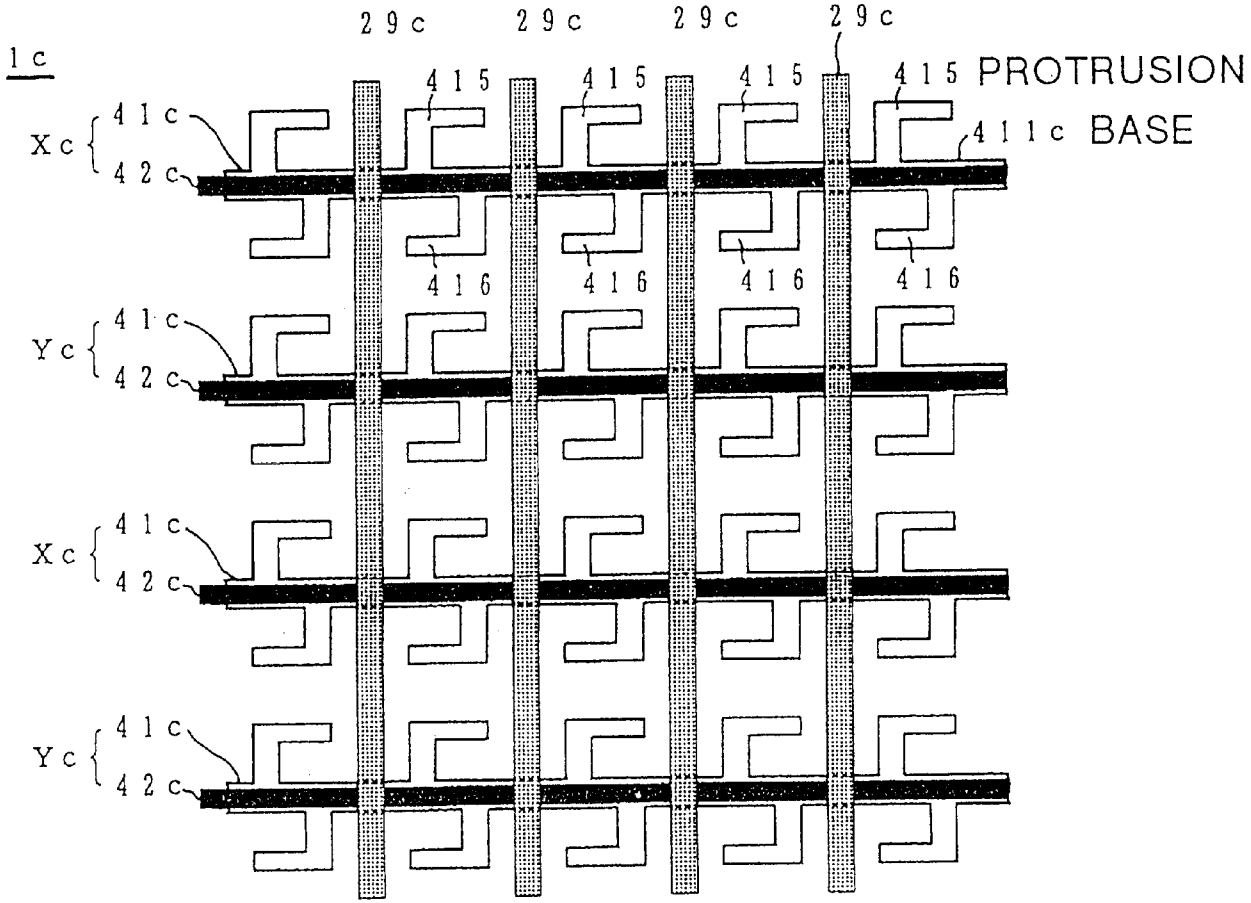
FIG. 8 is a plan view illustrating a modified configuration of main electrodes in accordance with the present invention.

In a PDP 1*c* shown in FIG. 8, main electrodes Xc and Yc are each comprised of a conductive transparent film 41*c* and a metal film 42*c* as in the example shown in FIG. 3. Since the entire metal film 42*c* is overlaid on the conductive transparent film 41*c* within the range of the screen, the plan-view shape of the conductive transparent film 41*c* itself is the shape of the main electrodes Xc and Yc.

The conductive transparent film 41*c* is patterned into a shape including a base 411*c* in a linear belt shape extending along the full length of the screen in the row direction and L-shaped protrusions 415 and 416 extending from the base 411*c* toward adjacent other conductive transparent films 41*c* in every column. The end parts of the protrusions 415 and 416 are in an orthogonal relation to the barriers ribs 29*c* and face the protrusions 416 and 415 of the adjacent conductive transparent films 41*c* with surface discharge gaps therebetween. With this configuration, the protrusions 415 and 416 have an elbow shape and in addition to that, the protrusions 415 and 416 extending from the same base in each column have shifted root positions. Therefore, the distance in the direction in which the discharge expands becomes longer. The preventing effect on the expansion of discharges are more improved.

Figure 9:
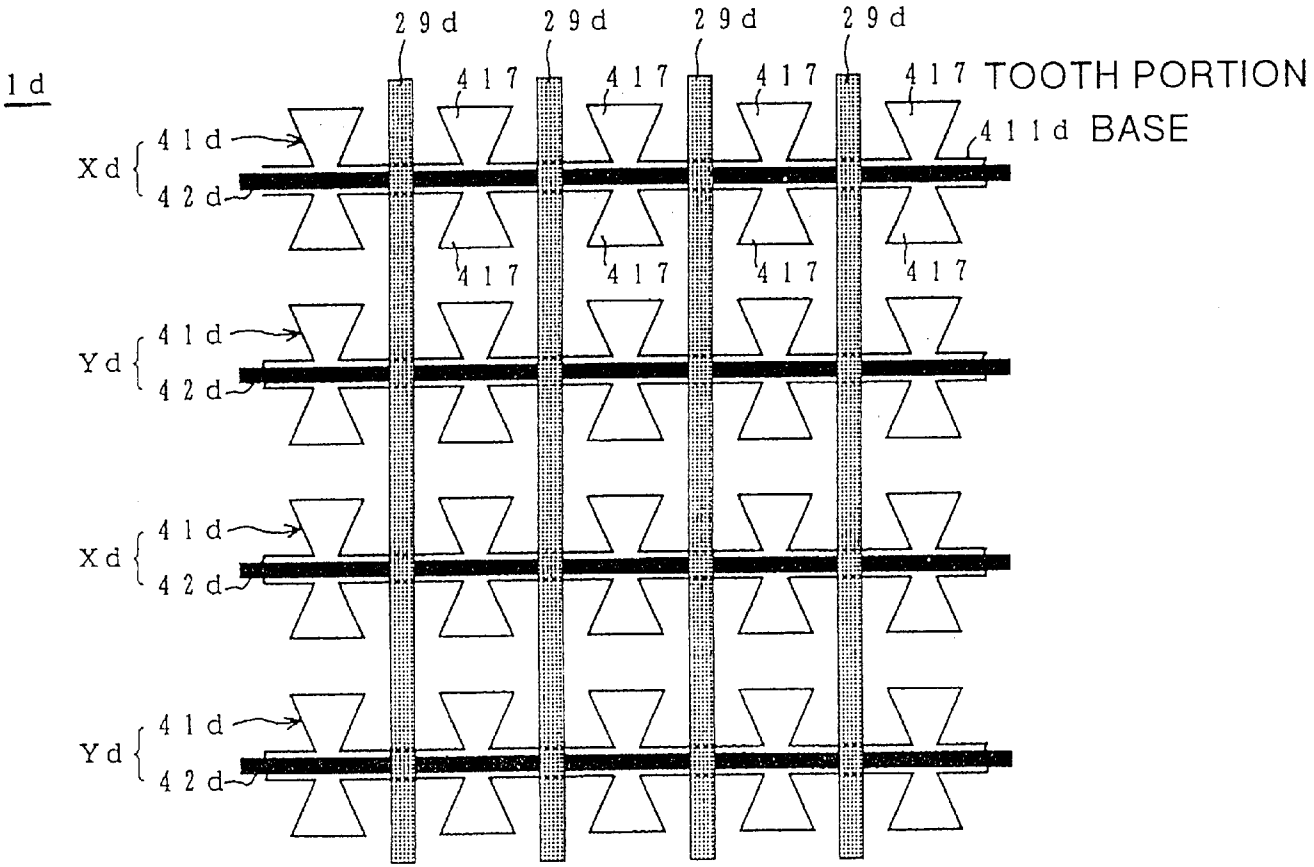
FIG. 9 is a plan view illustrating a modified configuration of main electrodes in accordance with the present invention.
Figure 10:
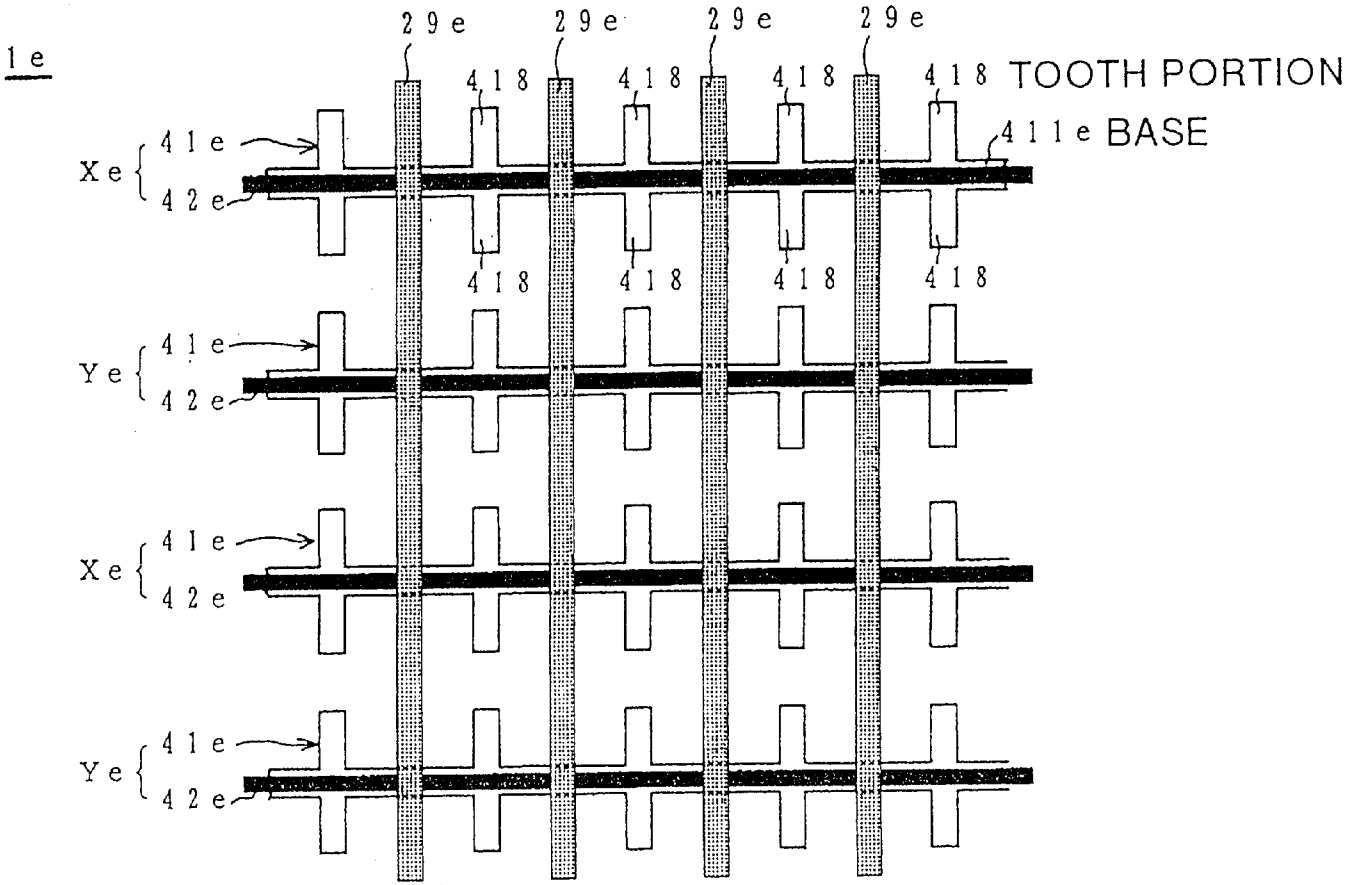
FIG. 10 is a plan view illustrating a modified configuration of main electrodes in accordance with the present invention.

Also in the PDP 1*d* shown in FIG. 9, main electrodes Xd and Yd are each comprised of a conductive transparent film 41*d* and a metal film 42*d*. The conductive transparent film 41*d* includes a base 411*c* in a linear belt shape extending along the full length of the screen in the row direction and protrusions (teeth) 417 in the shape of a reversed trapezoid extending from the base 411*d* toward adjacent other conductive transparent films 41*d* in every column partitioned by barrier ribs 29*d*.

In the above-described examples, the protrusions 413 to 417 are wider at their ends than at their roots on the bases. Therefore, the facing ends of the main electrodes sandwiching the surface-discharge gap is ensured to have a sufficient length in the row direction for suppressing increase of the firing voltage. Also the cut-off area of the main electrode is large enough for suppressing the expansion of surface discharges in the column direction. However, the protrusions 413 to 417 are not limited to the above-described shapes, but may be modified as appropriate depending upon dimensional conditions of cells. The protrusions are not necessarily required to have wider ends. For example, a PDP 1*e* shown in FIG. 10 bases 411*e* in a linear belt shape and protrusions 418 in a linear belt shape. The protrusions 418 are each provided in every column partitioned by barrier ribs 29*e*. The protrusions 418 extend from the bases 411*e* toward adjacent other conductive transparent films 41*d*. With this configuration of electrodes, the electrostatic capacity between adjacent main electrodes can be reduced than in the above-described configurations.

Figure 11:
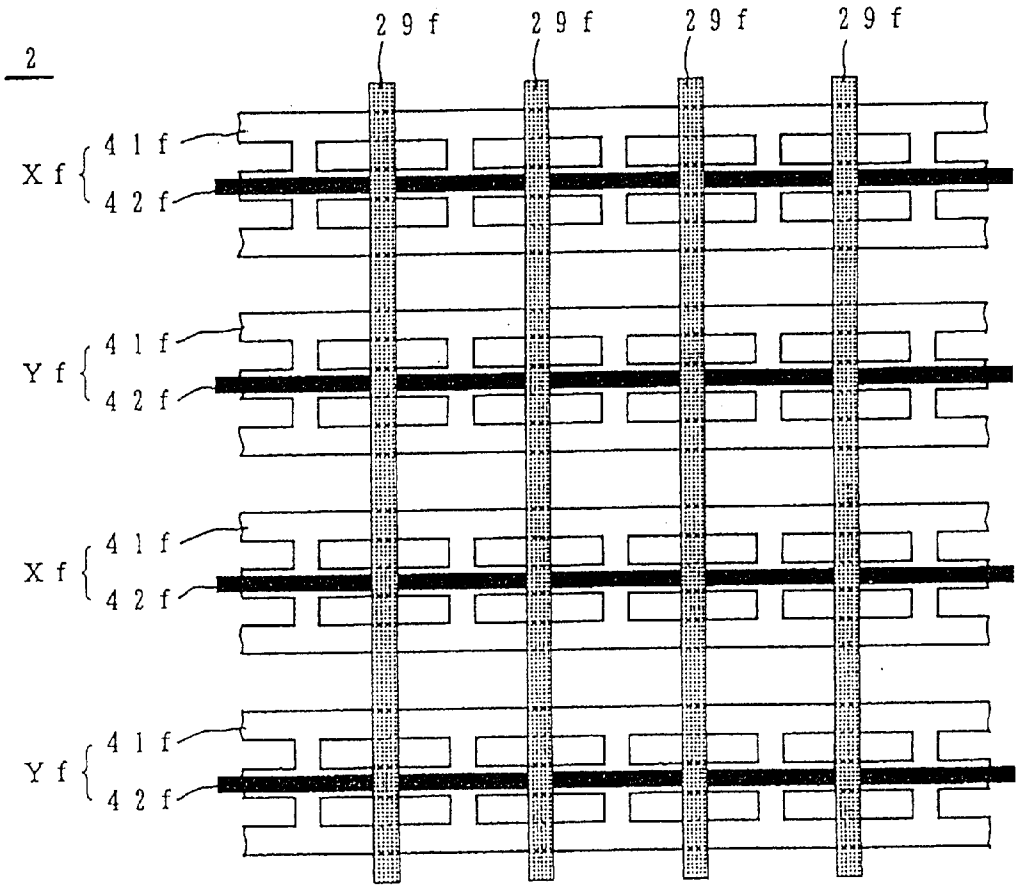
FIG. 11 is a plan view illustrating a configuration of main electrodes in accordance with a second embodiment of the present invention.

FIG. 11 is a plan view illustrating a configuration of main electrodes in accordance with a second embodiment of the present invention.

Also in a PDP 2 shown in FIG. 11, main electrodes Xf and Yf are each composed of a conductive transparent film 41*f* and a metal film 42*f*. The conductive transparent film 41*f* is in the shape of a linear belt of constant width which has openings. This shape corresponds to that of FIG. 3 wherein the end edges of the T-shaped protrusions 413 and 414 are continued in the row direction. This configuration is suitable for the case where the cell pitch in the row direction is too small to allow the T-shaped protrusions to have a sufficient width at the surface-discharge gap.

Figure 12:
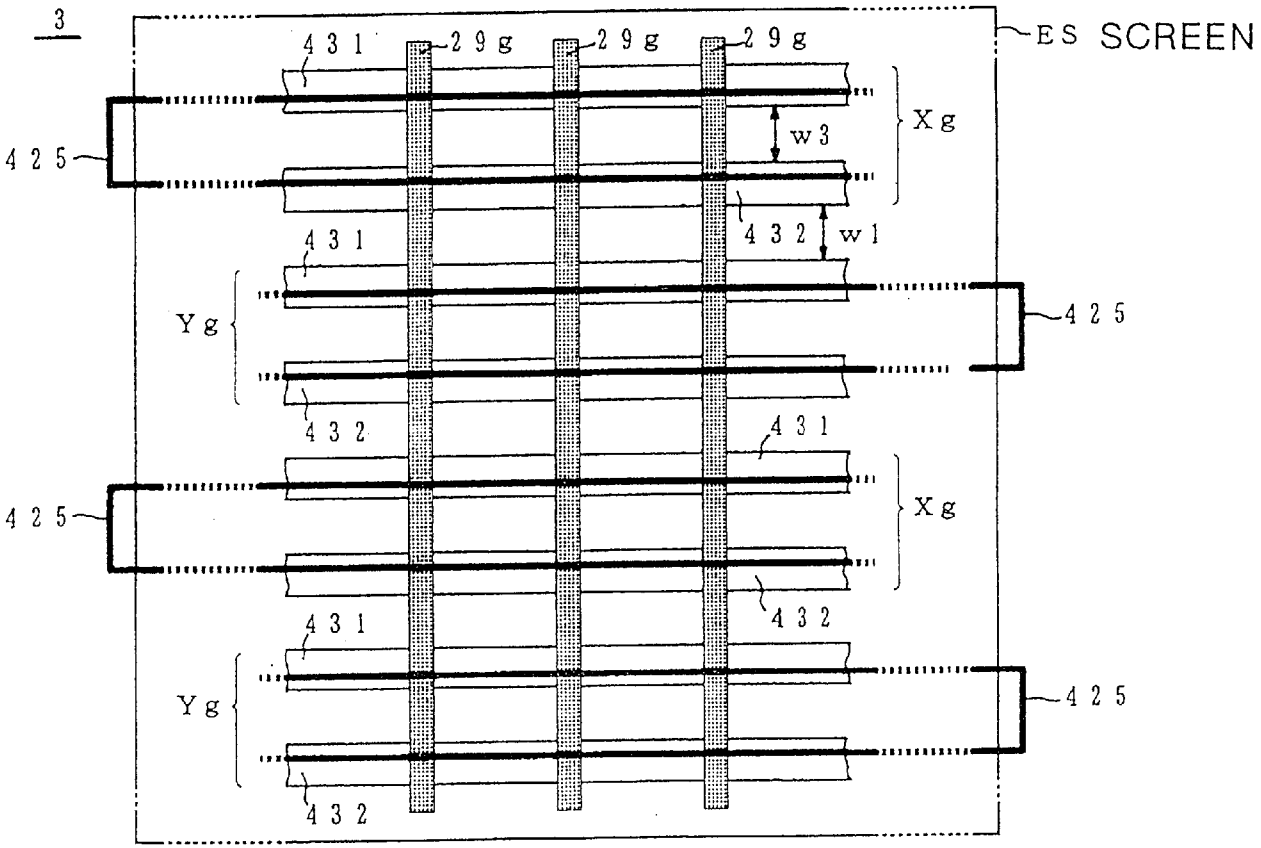
FIG. 12 is a plan view illustrating a configuration of main electrodes in accordance with a third embodiment of the present invention.

FIG. 12 is a plan view illustrating a configuration of main electrodes in accordance with a third embodiment of the present invention.

In a PDP 3 shown in FIG. 12, main electrodes Xg and Yg are each composed of two belt-shaped portions 431 and 432 which spacedly extend along the full length of the screen ES in the row direction and a connect portion 425 for electrically connecting the belt-shaped portions 431 and 432 outside the screen ES. The belt-shaped portions 431 and 432 are laminates of a belt-shaped conductive transparent film and a belt-shaped metal film having a smaller width than the conductive transparent film. The metal film is overlaid on the conductive transparent film, brought nearer to a side of the conductive transparent film distal to the surface-discharge gap. Only the metal films of the belt-shaped portions 431 and 432 are lead outside the screen ES and integrated with a metal film forming the connect portion 425. In the example shown in the figure, the belt-shaped portions 431 and 432 are connected at one end in the row direction, but may be connected at both ends to form an annular main electrode Xg or Yg.

In each of the main electrodes Xg and Yg, the longer the distance w3 between the belt-shaped portions 431 and 432 is, the greater the preventing effect of the expansion of surface discharges is. The distance w3 may be different from or the same as the surface-discharge gap w1.

In the above-explained examples, the present invention is illustrated with the construction in which the main electrodes are disposed on the substrate on the front side, but the invention can be applied to a construction in which the main electrodes are disposed on the substrate on the rear side. In the case of the main electrodes being disposed on the rear side, the main electrodes may be formed of a light-tight substance comprising a metal film. In any case, the shape of the main electrodes can be modified as appropriate in such an extent that discharge properties do not vary with all the rows.

According to the present invention, the expansion of discharges in the column direction can be suppressed and thereby the resolution can be improved. Further limitation on the maximum discharge current can be lowered and thereby the current capacity of the drive circuit can be eased.

Further, the electrostatic capacity across the electrodes can be reduced and thereby the power consumption can be decreased.

Still further, the rise of the firing voltage can be avoided and thereby the resolution can be improved.

What is claimed is:

1. A plasma display panel comprising a plurality of row electrodes arranged at equally spaced intervals defining rows of a screen, the row electrodes being arranged at intervals so that adjacent row electrodes are capable of serving as an electrode pair for generating a surface discharge, wherein each of the row electrodes includes a belt-shaped base extending along the full length of the screen in a direction of the rows and protrusions having a wide portion at an end thereof, extending from the base toward an adjacent row electrode in every column, the shape of each row electrode in a range corresponding to one column, a pair of the protrusions being symmetric to each other about a point of symmetry positioned centrally in the direction of the row on the base, and the surface discharge taking place at the wide portions of the protrusions.

2. The plasma display panel according to claim 1, wherein each of the protrusions is formed to be wider at its end than at its root on the base.

3. A plasma display panel comprising a plurality of row electrodes arranged at equally spaced intervals defining rows of a screen, the row electrodes being arranged at intervals so that adjacent row electrodes are capable of serving as an electrode pair for generating a surface discharge, wherein each of the row electrodes includes a belt-shaped base extending along the full length of the screen in a direction of the rows and T-shaped protrusions having wide portion at an end thereof, extending from the base toward an adjacent row electrode in every column, the shape of each row electrode in a range corresponding to one column, a pair of the T-shaped protrusions being symmetric to each other about a point of symmetry positioned centrally in the direction of the row on the base, and the surface discharge taking place at the wide portions of the protrusions.

4. A plasma display panel comprising a plurality of row electrodes arranged at equally spaced intervals defining rows of a screen, the row electrodes being arranged at intervals so that adjacent row electrodes are capable of serving as an electrode pair for generating a surface discharge, wherein each of the row electrodes includes a belt-shaped base extending along the full length of the screen in a direction of the rows and L-shaped protrusions having a wide portion at an end thereof, extending from the base toward an adjacent row electrode in every column, the shape of each row electrode in a range corresponding to one column, a pair of the protrusions being symmetric to each other about a point of symmetry positioned centrally in the direction of the row on the base, and the surface discharge taking place at the wide portions of the protrusions.

5. The plasma display panel according to claim 4, wherein, on each row, roots of the L-shaped protrusions extending from one side of the base are in shifted position in a direction of the rows with respect to roots of the L-shaped protrusions extending from the other side of the base.

6. A plasma display panel comprising a plurality of row electrodes arranged at equally spaced intervals defining rows of a screen, the row electrodes being arranged at intervals so that adjacent row electrodes are capable of serving as an electrode pair for generating a surface discharge, wherein each of the row electrodes includes a belt-shaped base extending along the full length of the screen in a direction of the rows and protrusions having a wide portion at an end thereof, extending from the base toward an adjacent row electrode in every column, and the protrusions are each formed in an elbow-shaped belt having a first linear portion extending from the base obliquely with respect to a direction of columns of the screen and a second linear portion extending from the first linear portion in the direction of the row from the end of the first linear portion wherein the shape of each row electrode in a range corresponding to one column, a pair of the protrusions being symmetric to each other about a point of symmetry positioned centrally in the direction of the row on the base, and the surface discharge taking place at the wide portions of the protrusions.

7. The plasma display panel according to claim 1, wherein at least the protrusions of the row electrode are formed of an electrically conductive transparent film.

8. The plasma display panel according to claim 7, wherein the base of the row electrode is formed of a laminate of an electrically conductive transparent film and a metal film.

9. A plasma display panel comprising a plurality of row electrodes being arranged at equally spaced intervals defining rows of a screen, the row electrodes being arranged at intervals so that adjacent row electrodes are capable of serving as an electrode pair for generating a surface discharge, wherein each of the row electrodes includes a couple of belt-shaped electrodes spacedly extending along the full length of the screen in a direction of the rows and a connection for electrically connecting the belt-shaped electrodes outside the screen, and the surface discharge taking place across all adjacent belt-shaped electrodes of the adjacent row electrodes.

10. The plasma display panel according to claim 10, wherein the belt-shaped electrodes are formed of an electrically conductive transparent film and the connection is formed of a metal film.

11. A plasma display panel comprising a plurality of row electrodes being arranged at equally spaced intervals defining rows of a screen, the row electrodes being arranged at intervals so that adjacent row electrodes are capable of serving as an electrode pair for generating a surface discharge, wherein each of the row electrodes includes three or more belt-shaped electrodes spacedly extending along the full length of the screen in a direction of the rows and connection for electrically connecting the belt-shaped electrodes in each column, the surface discharge taking place across all adjacent belt-shaped electrodes of the adjacent row electrodes.

12. The plasma display panel according to claim 1, further comprising belt-shaped ribs for partitioning the screen in columns, wherein, in each column, a discharge space is continuous along the full length of the screen in the direction of the column.

13. The plasma display panel according to claim 1 further comprising a plurality of column electrodes for addressing, the column electrodes being crossed with the row electrodes.

14. A plasma display device comprising a plasma display panel as recited in claim 1 and a drive circuit for applying drive voltage to electrode pairs so that one of two fields into which one frame is divided is displayed by odd-numbered rows and the other of the two fields is displayed by even-numbered rows.

15. A plasma display panel comprising a plurality of row electrodes to generate a surface discharge, the row electrodes being arranged at equally spaced intervals, comprising a belt-shaped base and T-shaped protrusions having a wide portion at an end thereof extending from the base toward an adjacent row electrode, the shape of each row electrode in a range corresponding to one column, a pair of the protrusions being symmetric to each other about a point of symmetry positioned centrally in the direction of the row on the base, and the surface discharge taking place at the wide portions of the protrusions.

16. A plasma display panel comprising a plurality of row electrodes to generate a surface discharge, the row electrodes being arranged at equally spaced intervals, comprising a belt-shaped base and L-shaped protrusions having a wide portion at an end thereof extending from the base toward an adjacent row electrode, the shape of each row electrode in a range corresponding to one column, a pair of the protrusions being symmetric to each other about a point of symmetry positioned centrally in the direction of the row on the base, and the surface discharge taking place at the wide portions of the protrusions.

17. A plasma display panel comprising a plurality of row electrodes to generate a surface discharge, the row electrodes being arranged at equally spaced intervals, comprising a belt-shaped base and protrusions having a wide portion at an end thereof extending from the base toward an adjacent row electrode, wherein the protrusions are each formed in an elbow-shaped belt having a first linear portion extending from the base obliquely with respect to a direction of columns of a screen and a second linear portion extending from the first linear portion, the shape of each row electrode in a range corresponding to one column, a pair of the protrusions being symmetric to each other about a point of symmetry positioned centrally in the direction of the row on the base, and the surface discharge taking place at the wide portions of the protrusions.

18. A plasma display panel comprising a plurality of row electrodes to generate a surface discharge, the row electrodes being arranged at equally spaced intervals, comprising a belt-shaped base and trapezoid-shaped protrusions having a wide portion at an end thereof extending from the base toward an adjacent row electrode, the shape of each row electrode in a range corresponding to one column, a pair of the protrusions being symmetric to each other about a point of symmetry positioned centrally in the direction of the row on the base, and the surface discharge taking place at the wide portions of the protrusions.

19. A plasma display panel comprising a plurality of row electrodes to generate a surface discharge, the row electrodes being arranged at equally spaced intervals and having a pair of protrusions having a wide portion at an end thereof, comprising:

at least two belt-shaped base electrodes extending along the full length of a screen, and a connection to electrically connect the belt-shaped electrodes outside the screen wherein the shape of each row electrode in a range corresponding to one column, the pair of protrusions being symmetric to each other about a point of symmetry positioned centrally in the direction of the row on the base, and the surface discharge taking place at the wide portions of the protrusions.

20. The display panel according to claim 9, further comprising a plurality of ribs to divide the row electrodes into columns, wherein a shape of the electrodes is substantially the same within adjacent ones of the columns.

21. The display panel according to claim 11, further comprising a plurality of ribs to divide the row electrodes into columns, wherein a shape of the electrodes is substantially the same within adjacent ones of the columns.

* * * * *

UNITED STATES PATENT AND TRADEMARK OFFICE

CERTIFICATE OF CORRECTION

PATENT NO. : 6,495,957 B2
DATED : December 17, 2002
INVENTOR(S) : Seiki Kurogi et al.

It is certified that error appears in the above-identified patent and that said Letters Patent is hereby corrected as shown below:

Column 12,
Line 1, change "10" (second occurrence) to -- 9 --.

Signed and Sealed this

Twentieth Day of May, 2003

JAMES E. ROGAN
*Director of the United States Patent and Trademark Office*